United States Patent [19]

Pascucci

[11] Patent Number: 5,000,072

[45] Date of Patent: Mar. 19, 1991

[54] APPARATUS FOR LOCATING SECTIONS OF A WIND INSTRUMENT

[75] Inventor: Vito Pascucci, Kenosha, Wis.

[73] Assignee: G. LeBlanc Corporation, Kenosha, Wis.

[21] Appl. No.: 507,161

[22] Filed: Apr. 10, 1990

[51] Int. Cl.[5] ..... G10D 7/06

[52] U.S. Cl. ..... 84/380 R; 84/382

[58] Field of Search ..... 84/380, 382, 385, 387

[56] References Cited

U.S. PATENT DOCUMENTS

| | | | |
|---|---|---|---|
| 2,036,356 | 4/1936 | Pedler | 84/382 |
| 2,944,459 | 7/1960 | Simmonds | 84/380 R |
| 3,191,482 | 6/1965 | LeBlanc | 84/382 |
| 3,237,504 | 3/1966 | LeBlanc | 84/382 |
| 4,723,470 | 2/1988 | Yamaryo | 84/380 R |
| 4,825,742 | 5/1989 | Selmer | 84/380 R |

*Primary Examiner*—Lawrence R. Franklin

*Attorney, Agent, or Firm*—Richard Bushnell

[57] ABSTRACT

A musical wind instrument has a hollow, generally tubular body made up of a first body section and a second body section which may be telescopically interfitted to define the assembled wind instrument. Alignment and locating structures are located respectively on the first and second body sections for defining a predetermined orientation therebetween when interfitted into assembled condition. The alignment and locating structures include an axially projecting button-like member mounted on a peripheral surface of one of the body sections, and an axially inwardly extending recess in the other of the body sections of complementary form for receiving at least a portion of the projecting member when the first and second body sections are telescopically interfitted and brought into a desired radial alignment and fully axially and telescopically engaged.

4 Claims, 1 Drawing Sheet

APPARATUS FOR LOCATING SECTIONS OF A WIND INSTRUMENT

BACKGROUND OF THE INVENTION

This invention relates generally to musical wind instruments, and more particularly to novel means for properly aligning and locating the multiple pieces or sections of a musical wind instrument so as to assure proper assembly of the parts thereof in properly aligned condition.

While the present invention is illustrated and described hereinbelow with reference to its application to the assembly of the sections of a woodwind musical wind instrument such as a clarinet or a flute, the invention is not limited to this application. Generally speaking, woodwinds such as clarinets and flutes have two main body portions often referred to as an upper or upwind body portion or joint and a lower or downwind body portion or joint. When assembling these two body portions or sections, it is necessary to maintain a certain radial alignment. That is, in instruments such as clarinets, flutes, saxophones and the like, multiple finger holes and finger-operated keys must be held in coaxial alignment for proper playing of the instrument. Moreover, in some of these instruments, certain of the finger-actuated key structures must overlap or cross over the joint between the two sections or portions, and hence these overlapping portions must also be properly aligned and interfitted to assure proper operation thereof during playing. Most players also prefer a given alignment of the mouthpiece section of the clarinet or other horn with the body thereof as well.

Similarly, with respect to other wind instruments such as the saxophone, it is desirable to maintain a given alignment between the neck and the main body of the saxophone upon assembly. In many saxophone instruments, certain of the finger-operated keys such as an octave key must cross from the main body to the neck to control the flow of air through certain openings on the neck portion. Generally, these keys are activated by finger pads located on the body portion. Hence proper alignment of these keys is necessary as well in securing proper alignment between the neck and body portions of the saxophone.

Some of the brass wind instruments also have preferred alignments as between telescopically or otherwise slidably interfitted tubular parts or portions thereof, as for example between the brass wind mouthpiece and its assembly with the brass wind instrument body.

OBJECTS AND SUMMARY OF THE INVENTION

Accordingly, it is a general object of the invention to provide a novel and improved locating structure for properly aligning and locating respective parts of a multiple part musical wind instrument.

Briefly, and in accordance with the foregoing object, the present invention provides a locating arrangement for maintaining the proper alignment during assembly of a musical wind instrument.

The musical wind instrument comprises a first section and a second section; engagement means on said first and second sections for telescopically interfitting said first section and second section to define an assembled condition thereof. Alignment and locating means are located respectively on said first section and said second section for defining a predetermined orientation therebetween when interfitted into assembled condition. The alignment and locating means include an axially projecting button-like member mounted on a peripheral surface of one of said first and second sections, and an axially inwardly extending recess in the other of said first and second sections of complementary form for receiving at least a portion of said projecting member when the said first and second sections are telescopically interfitted and brought into a desired radial alignment and fully axially and telescopically engaged.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
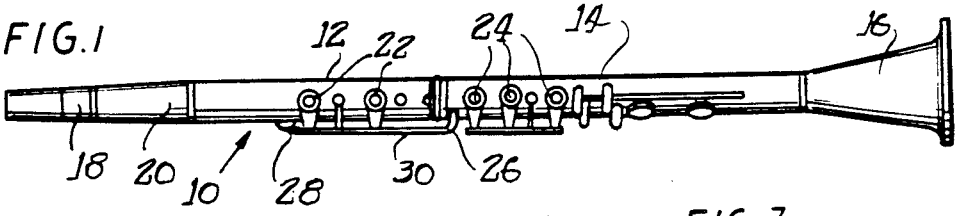
FIG. 1 is a simplified plan view of a musical wind instrument such as a clarinet.

Referring now to the drawings, the locating and alignment arrangement of the invention is illustrated herein in connection with a clarinet. However, it should be appreciated that the invention may also be utilized in connection with other wind musical instruments, both of the woodwind family, such as flutes and saxophones, or of the brass wind family, such as trumpets or the like, without departing from the invention.

Figure 2:
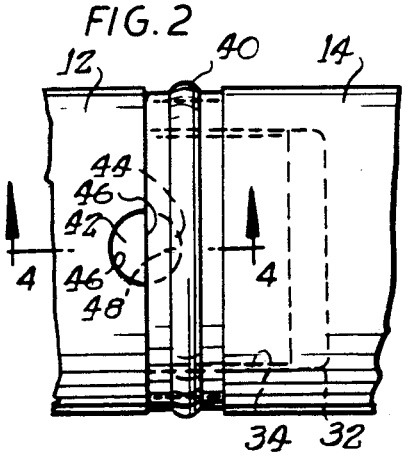
FIG. 2 is an enlarged partial view of the instrument of FIG. 1, showing an area between two joined parts with which the arrangement of the invention is utilized.
Figure 3:
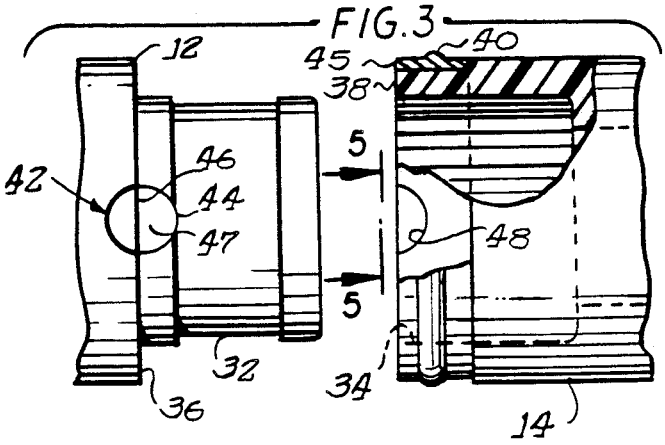
FIG. 3 is an exploded view similar to FIG. 2 and partially broken away, illustrating further details of the locating arrangement of the invention.

Referring initially to FIGS. 1–3, a woodwind instrument such as a clarinet 10 has a first or upwind body portion or section 12 and a second or downwind body portion or section 14. The first and second body sections 12 and 14 are generally disassembled when the instrument is not in use for placement in a case for protecting and transporting the instrument. An additional bell section 16 is also generally removable, as is an upper mouthpiece section 18. A small intermediate barrel section 20 between the mouthpiece 18 and upper body section 12 may also be removable for storage and transport.

When reassembling the instrument it is important to maintain a given radial alignment between the upper and lower body sections 12, 14 and more particularly to maintain a generally coaxial alignment between certain keys 22, 24 thereof. In addition, certain of the finger-operated keys such as key 26 are operated from one of the body sections but operate a key pad or opening located on the other of the body sections, such as indicated at reference numeral 28. Accordingly, the finger-operated key 26 is joined to the pad 28 by an elongate lever 30 which must extend over the joint between the sections and maintain a given alignment of key 26 relative to the other keys 22, 24. Alternatively, keys such as this may employ a lever 30 which is broken into two parts (not shown in FIG. 1), one being mounted to the upper body section 22 and the other being mounted to the lower body section 24. In assembling the instrument it is essential that the two halves of this elongate operating lever 30 also be aligned and joined in operable condition.

Heretofore, such alignment was achieved manually and by visual inspection by the instrumentalist upon assembly of the instrument. That is, the upper and lower body sections 22 and 24 were generally joined in a telescoping relation by rotating and pressing the two sections together. This action is indicated generally in FIGS. 2 and 3, therein it will be seen that upper body section 22 has a reduced diameter projecting barrel-like portion 32 and similarly, lower body portion or section 24 has an inwardly recessed, generally cylindrical undercut portion or recess 34. This recess 34 is of complementary cylindrical form for receiving the reduced diameter cylindrical projecting portion 32 telescopically therewithin. When these two sections are thus joined, respective generally annular outwardly facing end surfaces 36 and 38 of the upper and lower body sections are held together in face-to-face abutting condition as indicated in FIG. 2. In accordance with conventional practice, the lower body section 14 is also provided with a radially outermost tenon ring 40, preferably of metal, to impart additional strength to its outermost end where it joins with the reduced diameter projecting barrel portion 32 of the upper body section 12.

Departing from convention, and in accordance with the present invention, there is provided an axially projecting, button-like member 42, preferably of metallic material, mounted to a peripheral surface portion of the upper body section 12. This button 42, as illustrated herein, is generally cylindrical and disc-like in shape and is mounted in a complementary recess 46 formed in the annular end surface 36 of body section 12 such that substantially one-half of the button projects axially outwardly thereof as indicated by reference numeral 44. Additionally, this substantially one-half cylindrical portion of the button 42 is radially inwardly stepped as best viewed in FIG. 6, to further define a flat, axial surface 46 and a crowned, radial surface 47. This crowned surface 47 is of complementary curvature for interfitting with recess 48 beneath the tenon ring 40.

Cooperatively, the annular end surface 38 of the lower body section 14 is provided with a complementary generally semi-cylindrical recess 48 for receiving therewithin the projecting portion 44 of the button 42 when the two body sections are pressed together into assembled condition and properly aligned. Hence the projecting portion 44 will prevent full seating and assembly of the two body sections until they are relatively rotated into proper alignment wherein the projecting button portion 44 fully engages and seats within its complementary recess 48.

Figure 4:
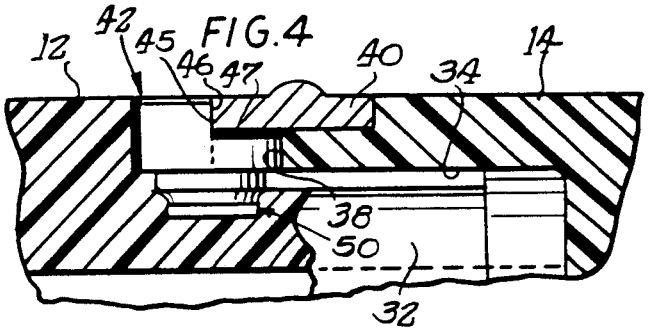
FIG. 4 is a further enlarged sectional view taken generally along the line 4—4 of FIG. 2.
Figure 5:
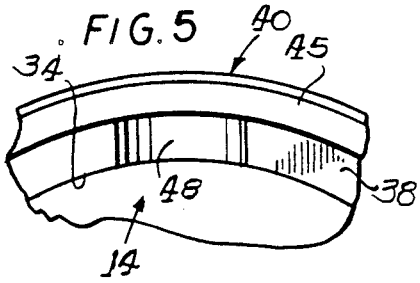
FIG. 5 is a partial end view taken generally in the plane of the line 5—5 of FIG. 3.
Figure 6:
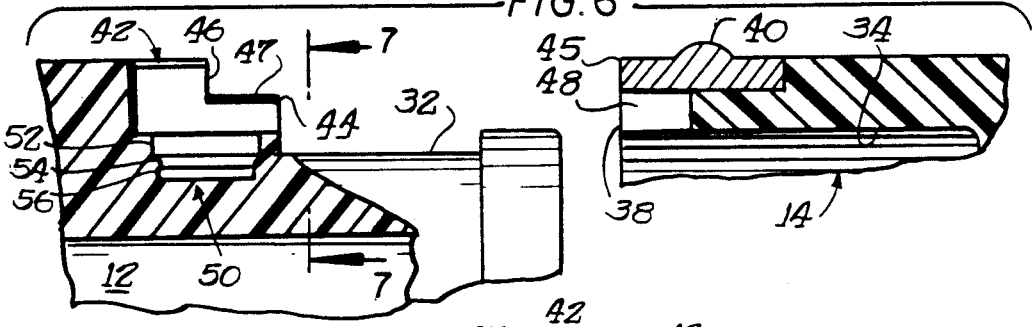
FIG. 6 is an exploded partial sectional view of the section shown in FIG. 4.
Figure 7:
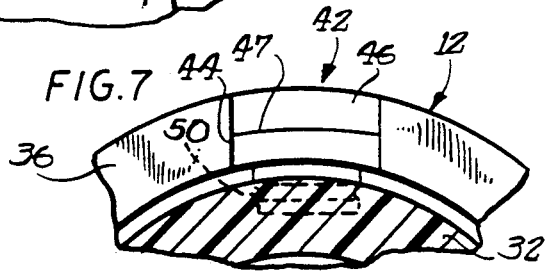
FIG. 7 is a view taken generally along the line 7—7 of FIG. 6.

As best viewed in FIGS. 4 and 6, the cylindrical button-like body 42 further has a radially inwardly extending joining portion 50. In the illustrated embodiment this joining portion has an initially stepped-down diameter portion 52, a generally radially tapered projecting portion 54 and an enlarged diameter rim portion 56. This complex shape helps to retain the joining portion 50 in firm engagement with a complementary recess which is formed for receiving the same in the upper body portion 12, in an area which generally overlaps the full outer diameter portion thereof, and the reduced diameter barrel portion 32. Suitable adhesive may further be utilized to secure the button 42 in place in this fashion.

It will be noted also that the stepped-down portion 44 leaves the flat, axially outwardly facing surface 46, which is generally flush with the annular end surface 36 when the button is mounted to the body section 12 as illustrated. Hence, the projecting semi-cylindrical portion 44 prevents face-to-face abutting engagement between the annular end surfaces 36 and 38 when portion 44 is out of alignment with its complementary recess 48, thus achieving the desired function by preventing full seating of the surfaces for assembly of the instrument when the body parts of the instrument are misaligned.

It will be further noted that the recess 48 is formed entirely within the material of the body portion 14, such that the tenon ring 40 overlies this recess, as best viewed in FIG. 6. Accordingly, the surface 47 of projecting portion 44 of the button will be completely overlapped by the tenon ring 40 when the instrument is fully assembled, as best viewed in FIG. 4. An annular end surface 45 of the tenon ring will abut end surface 36 of body section 12, and also surface 46 of button 42.

What has been illustrated and described herein is a novel locating and aligning arrangement for aiding in proper assembly of multiple sections of a musical wind instrument. While the same has been illustrated and described herein in connection with a clarinet, it will be understood that the same arrangement may be utilized in connection with other musical wind instruments without departing from the invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A musical wind instrument comprising: a first section and a second section; engagement means on said first and second sections respectively for telescopically interfitting said first section and second section to define an assembled condition thereof; and alignment and locating means located respectively on said first section and said second section for defining a predetermined orientation therebetween when interfitted into assembled condition, said alignment and locating means including an axially projecting member mounted on a peripheral surface of one of said first and second sections, and an axially inwardly extending recess in the other of said first and second sections of complementary form for receiving at least a portion of said projecting member when said first and second sections are telescopically interfitted and brought into a desired radial alignment and fully axially and telescopically engaged; said engagement means of said first section being generally cylindrical and hollow in form and of a given outer diameter for joining with the engagement means of said second section; wherein said engagement means of said second section is generally cylindrical and hollow in form, having an inner diameter substantially similar to the outer diameter of said first section engagement means for receiving the same axially telescopically interfitted therewithin, and respective axially outwardly facing abutment surfaces formed adjacent said engagement means of said first and second sections, said abutment surfaces being located in face-to-face abutting condition when the two sections are pressed together in assembled condition; wherein said projecting member projects from one of said abutment surfaces and wherein said recess means for receiving the same is recessed into the other of said abutment surfaces; wherein said projecting member is stepped radially inwardly; and wherein said other of said abutment surfaces has an outwardly extending portion which overlies said complementary recess and said stepped down portion of said projecting member when the same is brought into full engagement with the complementary recess, such that an axially outwardly facing surface of said projecting member defined by said stepped down portion thereof is brought together in facing and abutting condition with an axially outwardly facing end surface of said outwardly extending portion.

2. A musical wind instrument as set forth in claim 1 wherein said axially projecting member is button-like and comprises a generally cylindrical body having a radially inwardly extending joining portion thereon for joining the same with said peripheral part of said first section from which the same projects axially, and wherein said second section includes a semi-cylindrical recess for receiving said button-like member, such that substantially one-half of said cylindrical body projects axially therefrom.

3. A musical wind instrument as set forth in claim 2 wherein said recess means is substantially semi-cylindrical in form for complementary engagement with the projecting part of said cylindrical body of said button-like member.

4. A musical wind instrument according to claim 2 wherein said axially outwardly facing surface of said button-like member is substantially flush with said annular surface of the section to which it is joined.

* * * * *